US009027266B2

(12) United States Patent
Maher et al.

(10) Patent No.: US 9,027,266 B2
(45) Date of Patent: May 12, 2015

(54) WEAR RESISTANT COMPONENT

(75) Inventors: Patrick Gerard Maher, Naval Base (AU); Tymen Jacob Dinn Brom, Kensington (AU); Jonathan Clowes Pemberton, Naval Base (AU)

(73) Assignee: Excalibur Steel Company Pty Ltd (AU)

( * ) Notice: Subject to any disclaimer, the term of this patent is extended or adjusted under 35 U.S.C. 154(b) by 66 days.

(21) Appl. No.: 13/806,227

(22) PCT Filed: Jun. 28, 2011

(86) PCT No.: PCT/AU2011/000791

§ 371 (c)(1),
(2), (4) Date: Mar. 6, 2013

(87) PCT Pub. No.: WO2012/000023

PCT Pub. Date: Jan. 5, 2012

(65) Prior Publication Data

US 2013/0160335 A1 Jun. 27, 2013

(30) Foreign Application Priority Data

Jun. 28, 2010 (AU) ..... 2010902835

(51) Int. Cl.
*E02F 3/36* (2006.01)
*E02F 9/28* (2006.01)

(52) U.S. Cl.
CPC ..... *E02F 9/285* (2013.01); *E02F 9/2858* (2013.01); *E02F 9/2883* (2013.01)

(58) Field of Classification Search
USPC ..... 172/701.3, 713, 719, 747; 37/452, 453, 37/460, 444; 404/121, 124
See application file for complete search history.

(56) References Cited

U.S. PATENT DOCUMENTS

| | | | | |
|---|---|---|---|---|
| 3,778,580 | A * | 12/1973 | Bierwith | 219/73.1 |
| 3,932,952 | A * | 1/1976 | Helton et al. | 37/460 |
| 3,970,445 | A * | 7/1976 | Gale et al. | 420/64 |
| 4,017,480 | A * | 4/1977 | Baum | 428/601 |
| 5,081,774 | A * | 1/1992 | Kuwano | 37/460 |
| 7,909,279 | B2 * | 3/2011 | Condon et al. | 241/275 |
| 8,016,219 | B2 * | 9/2011 | Condon et al. | 241/182 |
| 2011/0259541 | A1 * | 10/2011 | Brom et al. | 164/69.1 |

FOREIGN PATENT DOCUMENTS

| | | | |
|---|---|---|---|
| JP | 11-059835 | 3/1999 | B23K 9/00 |
| WO | WO 2009/086590 | 7/2009 | E02F 9/28 |

OTHER PUBLICATIONS

Form PCT/ISA/210—Int'l Search Report (from corresponding Int'l Patent App. No. PCT/AU2011/000791—4 pages.

* cited by examiner

*Primary Examiner* — Gary Hartmann
(74) *Attorney, Agent, or Firm* — Kusner & Jaffe

(57) ABSTRACT

A wear component for use on, for instance, an excavator formed by a shell formed from a tough metal such as carbon steel and an inner body formed from an abrasion resistant metal such as a chromium white iron. The shell includes cross portions extending through the inner body, the cross portions being made of the tough metal. This has the effect of strengthening the overall toughness of the wear component, while retaining desirable abrasion resistance.

15 Claims, 9 Drawing Sheets

WEAR RESISTANT COMPONENT

FIELD OF THE INVENTION

The present invention relates to components which are resistant to abrasive wear. It has been conceived primarily for use in relation to heel shrouds, arranged to attach to the heel of an excavator bucket, and similar wear parts for excavator buckets such as corner shrouds, wings shrouds, wear bars, lips and wear caps. Aspects of the invention are considered to have wider application than this, and may also be applied to other wear-exposed apparatus, including fixed apparatus.

BACKGROUND TO THE INVENTION

Parts of earth moving machinery and related equipment are subject to significant wear during use, principally due to abrasion. In an attempt to reduce the effects of this abrasion, wear components are often mounted to earth moving buckets and similar machinery. Typical wear components include heel shrouds, wear bars, corner shrouds and wing shrouds. These components are replaceable units, arranged to wear during use while protecting the bucket, and to be replaced before wearing completely through to the bucket.

It is desirable to make wear components from abrasion resistant materials, in order to extend their working life and to provide an enhanced benefit. It is also necessary to use materials which can withstand substantial impact forces, and the resulting stresses within the material. In general, it has been found that materials with high resistance to abrasive wear, such as chromium white irons and tungsten carbide composites, are generally too brittle to withstand the impact forces to which the heel shrouds are frequently subjected.

Additional difficulties have been experienced in successfully attaching components made of these materials to earth moving equipment. The materials are generally incapable of being welded, and the provision of holes and the like in the component for mechanical attachment can lead to unacceptable stress concentrations within the material.

As a result, most wear members are made from quenched and tempered steel, as this provides excellent strength properties along with a degree of resistance to abrasion.

An alternative type wear member has been proposed in the applicant's pending US patent application publication number US-2010-0275473-A1, the contents of which are incorporated herein by reference. This wear member comprises an outer shell of a tough metal such as a carbon steel, and an inner shell of an abrasion resistant metal such as a white iron.

This wear member has proved in testing to have many of the stated advantages. Nonetheless, it is considered desirable to provide a wear member having even greater strength than that of US-2010-0275473-A1.

It has also been observed that the use of an abrasion resistant material within an outer shell can significantly alter the wear rates of different parts of the wear member. It is considered desirable to take advantage of this observation in order to reduce the cost and weight of a wear member without substantially reducing its effectiveness. It is also considered desirable to provide a means of easily determining when a wear member has reached the end of its useful life.

Different aspects of the present invention seek to achieve these desiderata.

SUMMARY OF THE INVENTION

According to one aspect of the present invention there is provided a wear component formed from at least a first metallic material and a second metallic material, the first material having a toughness greater than that of the second material and the second material being more abrasion resistant than the first material; the component having a shell formed from the first material and an inner body formed from the second material, a metallurgical bond existing between the first material and the second material; wherein the shell includes at least one cross portion extending through the inner body, the cross portion being formed from the first material and having a first side and a second side each of which are bonded to the second material. It is preferred that the cross portion is elongate, with the first side being along one longitudinally extending side of the cross portion and the second side being on an opposite longitudinally extending side of the cross portion.

The wear component may be for use in conjunction with an excavator bucket. For instance, the wear component may be a heel shroud, a wear bar, a corner shroud, a wear cap or a wing shroud.

Preferably, the shell includes a plurality of cross portions. These cross portions may be arranged parallel to each other, or may be arranged such that at least one cross portion intersects another cross portion within the inner body.

In a preferred embodiment, the shell includes opposed end walls and opposed side walls, with at least one cross portion extending between the opposed end walls and at least one cross portion extending between the opposed side walls.

The shell defines a volume arranged to contain the inner body. This volume has a base, and an upper edge which is defined by upper edges of the end walls and side walls when the wear member is so oriented. It is preferred that at least some of the cross portions are arranged such that the shell includes a space between at least part of these cross portions and the base; that is, that a portion of the inner body is located between the base and the particular cross portion. Preferably, the arrangement is such that the inner body is contiguous. This means that if the second metal is poured in a molten state into the shell, it will fill the shell to the upper edge with no voids remaining.

It is also preferred that at least some of the cross portions are arranged so as to have an upper edge which is level with the upper edges of the end walls and side walls.

In accordance with a second aspect of the present invention there is provided a wear component including:

an inner face for attachment to apparatus subject to wear, the attachment defining a protected surface portion of the apparatus; and an outer face which is exposed, in use, to abrasive wear;

a volume being defined between the protected surface portion of the apparatus and the outer face of the wear component representing the effective volume of the wear component;

wherein a portion of this volume contains a void.

The apparatus may be an excavator bucket. In this case, the wear component may be a heel shroud, and the protected surface portion of the bucket part of the bucket heel. Alternatively, the component may be a wear bar, a corner shroud, a wear cap or a wing shroud.

It is envisaged that the void will contain air, although it will be appreciated that the void may be filled with some material less dense than metal without departing from the scope of the invention.

It is preferred that the void be open; that is, be located between part of the inner face of the component and part of the protected surface portion of the bucket. It is alternatively considered possible to locate the void entirely within the component.

BRIEF DESCRIPTION OF THE DRAWINGS

It will be convenient to further describe the invention with reference to preferred embodiments of the wear member of the present invention. Other embodiments are possible, and indeed other wear components can be formed in a similar fashion, and consequently the particularity of the following discussion is not to be understood as superseding the generality of the preceding description of the invention. In the drawings.

DETAILED DESCRIPTION OF PREFERRED EMBODIMENTS

Figure 1:
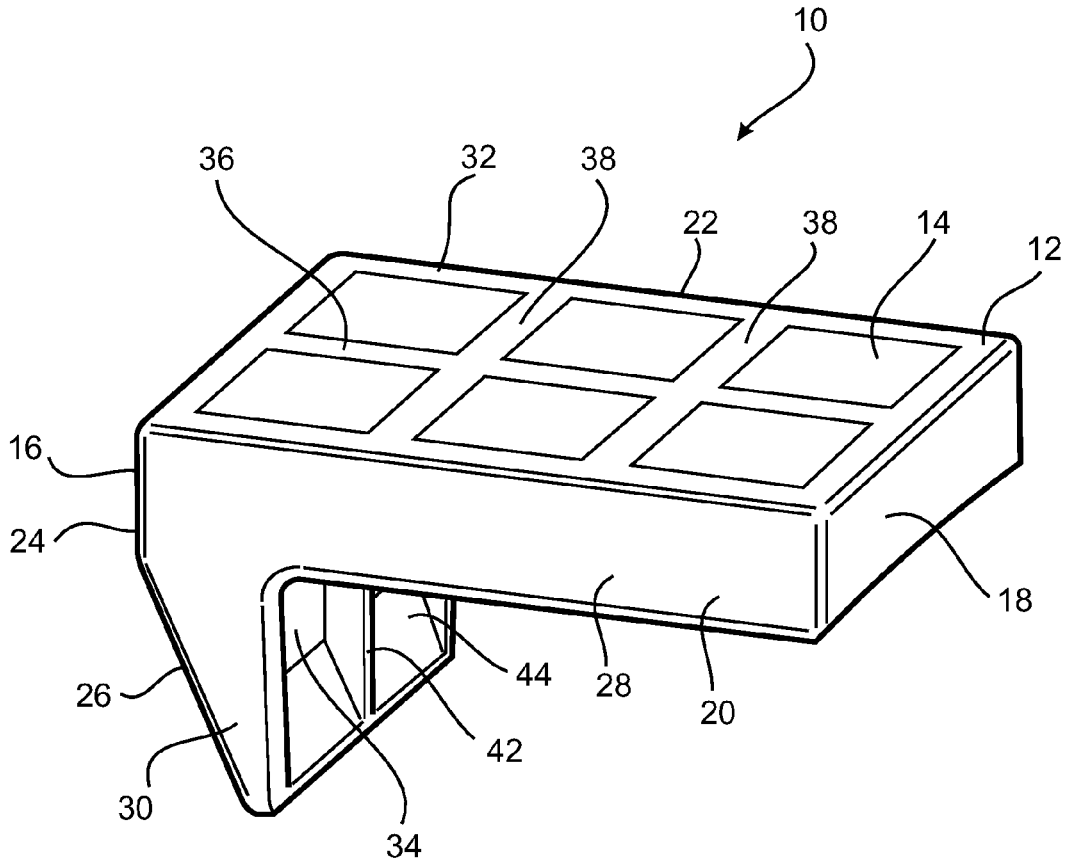
FIG. 1 is an upper perspective of a heel shroud in accordance with the present invention.
Figure 2:
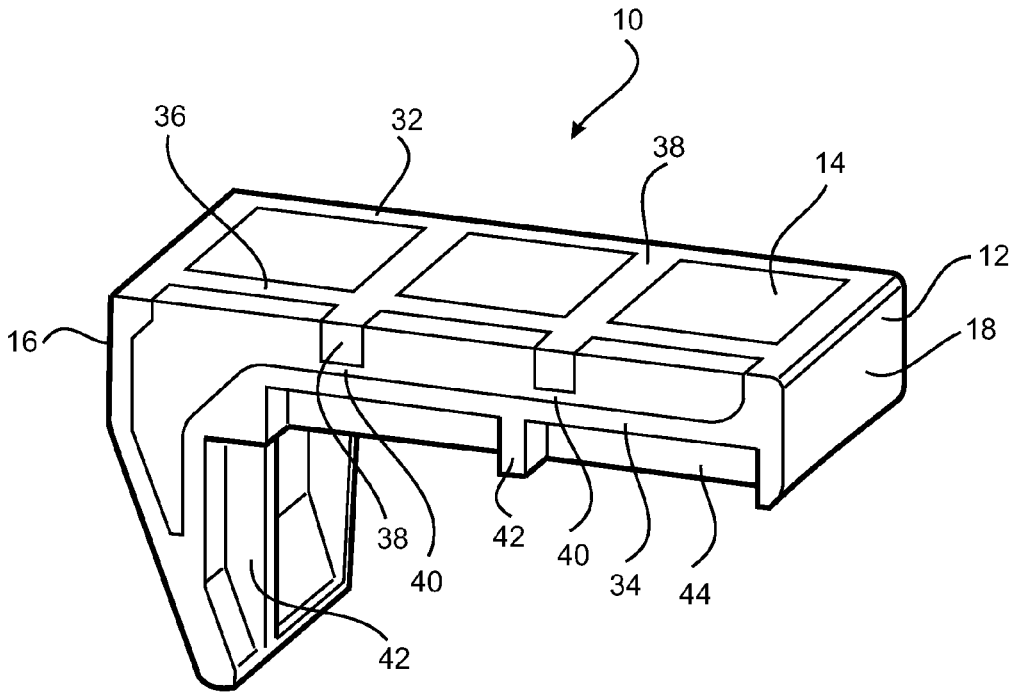
FIG. 2 is a cut-away upper perspective of a heel shroud in accordance with the present invention.
Figure 3:
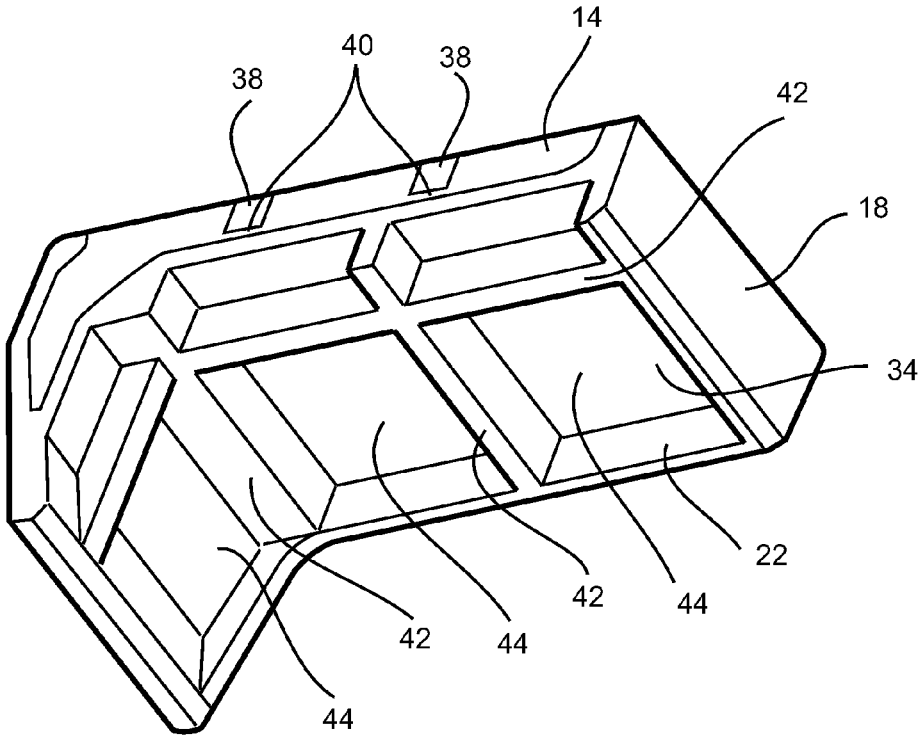
FIG. 3 is a cut-away lower perspective of the heel shroud of FIG. 1.
Figure 4:
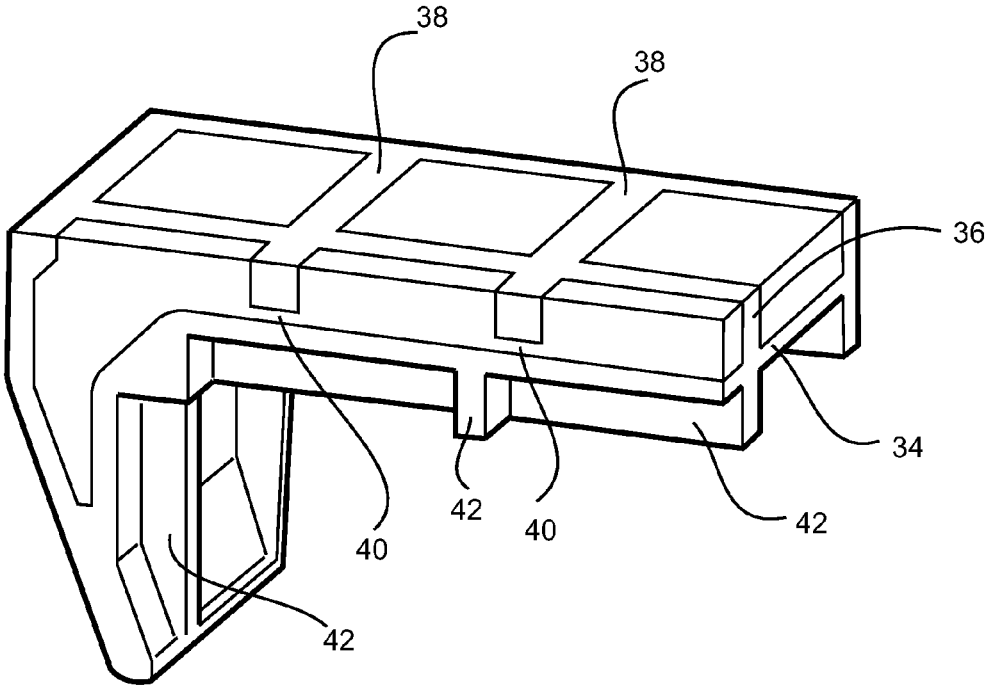
FIG. 4 is a doubly cut-away upper perspective of the heel shroud of FIG. 1.
Figure 5:
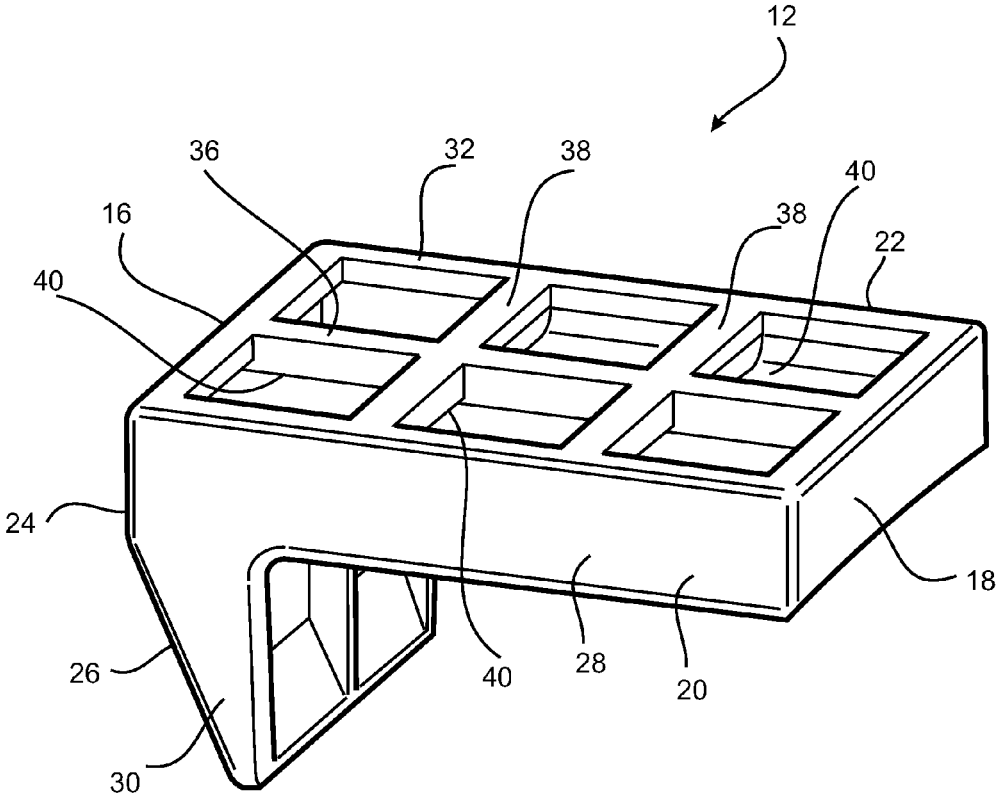
FIG. 5 is an upper perspective of a shell of the heel shroud of FIG. 1.
Figure 6:
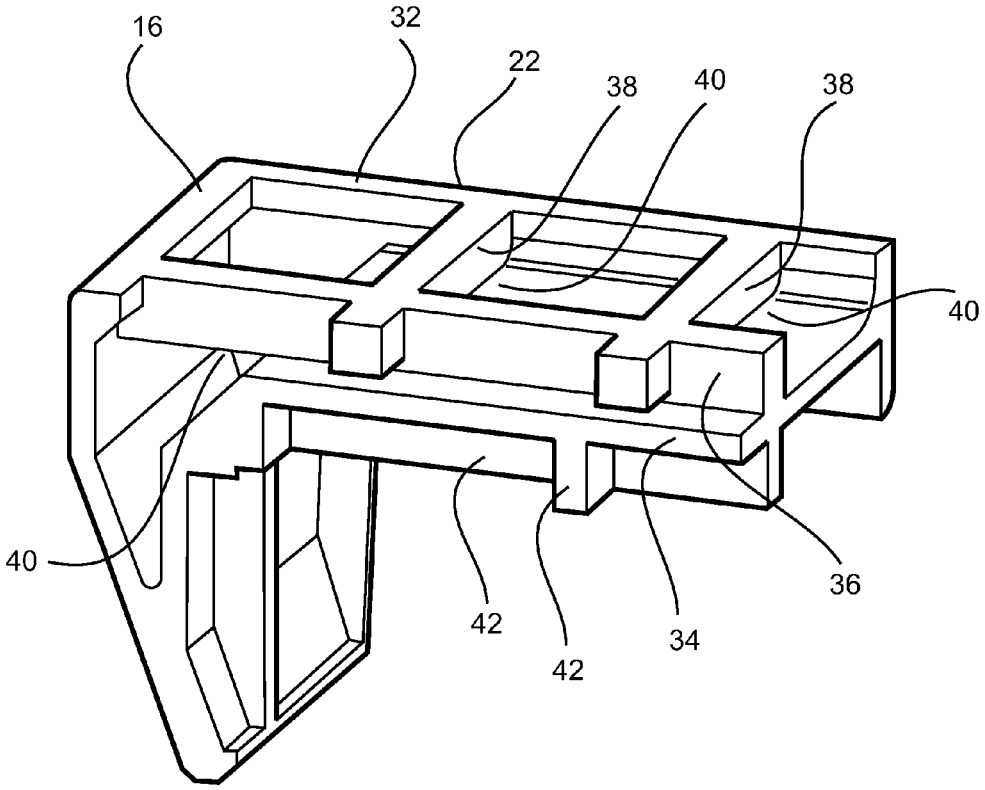
FIG. 6 is a doubly cut-away upper perspective of the shell of FIG. 5.
Figure 7:
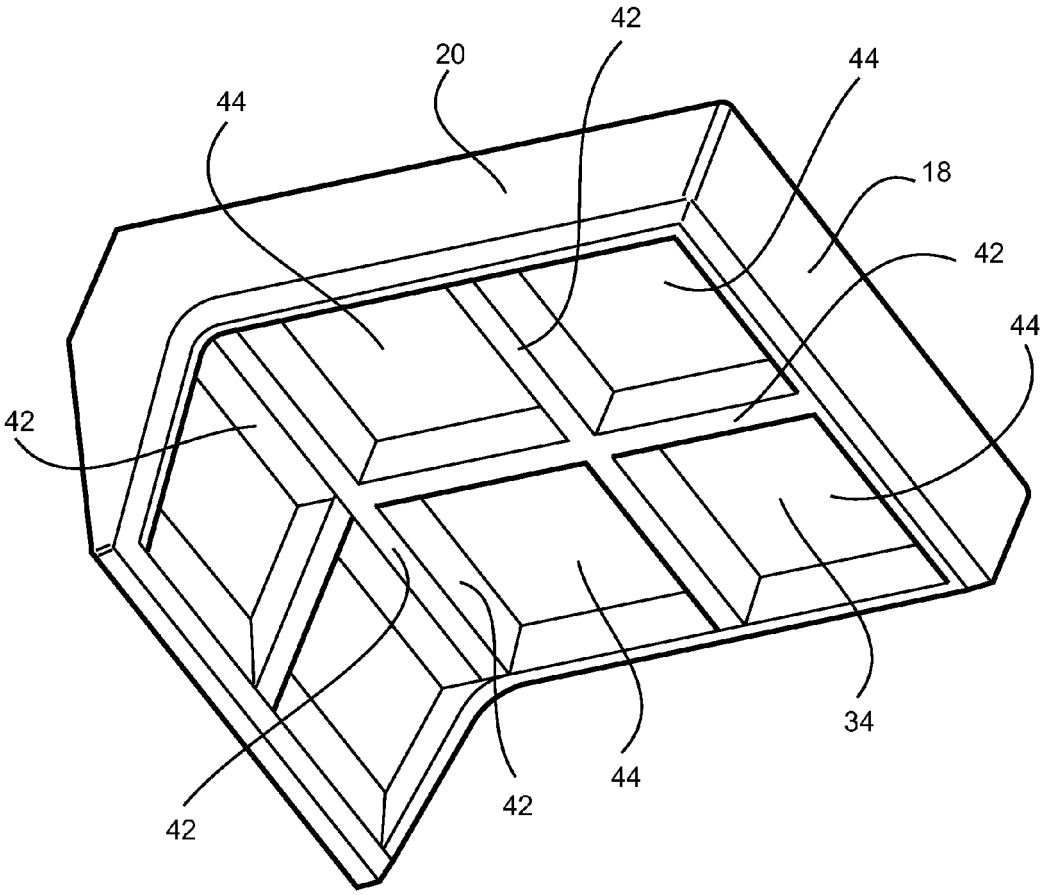
FIG. 7 is a lower perspective of the shell of FIG. 5.

FIG. 1 shows a heel shroud 10, formed of an outer shell 12 and an inner body 14. The shell 12 is formed from a first metallic material, being one having a relatively high fracture toughness and requiring relatively high impact energy to cause fracture. The first metallic material is one suitable for welding to a heel of an excavator bucket (not shown). The first metallic material may be a mild steel, a higher strength carbon steel or a steel alloy, suitably treated (for instance by case carborising, induction hardening, quenching and/or tempering) to achieve the required properties.

The inner body is formed from a second metallic material, being one having a high resistance to abrasion. The second metallic material may be an alloy white iron, such as one containing 9-15% chromium; 3.5-4.5% carbon; 0.4-0.7% silicon; 1.0-4.0% manganese; and 0.5-3.0% nickel. Alternatively, the second metallic material may be an alloy chosen from alloys containing carbides of chromium, tungsten, boron, molybdenum, niobium, titanium, vanadium, or the like.

The shell 12 includes an outer end wall 16, an inner end wall 18, a first side wall 20 and a second side wall 22. The outer end wall 16 has a first portion 24, which is parallel to and opposite the inner end wall 18; and a second portion 26 which extends, in use, along the side wall of an excavator bucket, and which is angled towards the side wall of the excavator bucket.

Similarly the side walls 20, 22, which are parallel to and opposite each other, each have a first portion 28 which is substantially rectangular, extending between the inner end wall 18 and the first portion 24 of the outer end wall 16, and a second portion 30 which is substantially right-triangular in shape, and extends in use between the side wall of the excavator bucket and the second portion 26 of the outer end wall 16.

The inner end wall 18 and the first portions 24, 28 of the outer end wall 16 and side walls 20, 22 form an open rectangular prism. When the shell 12 is oriented such that the second portions 26, 30 are pointing down, upper edges of the inner end wall 18 and the first portions 24, 28 of the outer end wall 16 and side walls 20, 22 define an upper edge 32 of the shell 12.

The shell 12 defines a volume which is filled by the inner body 14. The volume is defined by the upper edge 32; the end walls 16, 18; the side walls 20, 22; and a base 34. The base 34 broadly follows the shape of the heel of the excavator bucket to which the shroud 10 is to be attached, but is spaced from it as will be discussed below.

The shell 12 includes one longitudinal cross portion 36 and two transverse cross portions 38. The longitudinal cross portion 36 extends from the centre of the inner end wall 18 to the centre of the first portion 24 of the outer end wall 16. The longitudinal cross portion 36 is parallel to, and similar in thickness to, the first portions 28 of the first and second side walls 20, 22, and is located about midway between them.

The longitudinal cross portion 36 extends from the upper edge 32 of the shell 12 to the base 34 of the shell volume near the inner end wall 18. The longitudinal cross portion 36 would thus act to divide the shell volume in two, except that where the base 34 follows the curve of a bucket heel around to the bucket side wall the longitudinal cross portion 36 remains of constant depth. There is thus a gap 40 between the longitudinal cross portion 36 and the base 34 near the second portion 26 of the outer end wall 16.

Each of the transverse cross portions 38 extends from the first portion 28 of the first side wall 20 to the first portion 28 of the second side wall 22. The transverse cross portions 38 are parallel to, and similar in thickness to, the inner end wall 18. They are equally spaced along the side walls 20, 22 between the inner end wall 18 and the first portion 24 of the outer end wall 16. The transverse cross portions 38 extend from the upper edge 32 of the shell 12 towards the base 34 of the shell volume, but do not meet the base 34. There are gaps 40 between the transverse cross portions 38 and the base 34. It will be appreciated that the longitudinal cross portion 36 is perpendicular to the transverse cross portions 38, and intersects each of them.

The cross portions 36, 38 are integral to, and formed of the same material as, the remainder of the shell 12.

The heel shroud 10 may be formed using the techniques discussed in WO 2009/086590, whereby a metallurgical bond is created between the shell 12 and the inner body 14. It will be appreciated that the longitudinal cross portion 36 has two sides, each of which is parallel to the side walls 20, 22. The arrangement is such that the longitudinal cross portion 36 bonds to the second material on each of these sides. Similarly, the transverse cross portions 38 each have two sides parallel to the inner end wall 18, and the transverse cross portions 38 bond to the second material on each side.

Where the second material is poured as a liquid, or melted within the shell to be flowable, it will pass beneath the gaps 40 and fill the volume of the shell 12 to the upper edge 32. The inner body 14 thus formed will have portions extending between the cross members 36, 38 and the base 34, and will be a single contiguous body.

The heel shroud 10 has the abrasion resistance provided by the inner body 14, but has a strength reinforced by the cross members 36, 38.

As noted above, the base 34 is spaced from the bucket heel when the heel shroud 10 is attached. The arrangement is such that the heel shroud 10 includes a plurality of supporting members 42 extending between the base 34 and the bucket heel. These supporting members 42 cooperate with lower edges of the inner end wall 18 and first portions 28 of the side walls 20, 22, and inner edges of the second portions 30 of the side walls 20, 22, to provide a supporting structure for the heel shroud 10 which can be bonded (such as by welding) to the bucket heel. A void in the form of an air gap 44 is maintained in between the supporting members 42, and the sides walls 20, 22 and inner end wall 18, between the base 34 and the bucket heel.

The air gap 44 significantly reduces the weight of the heel shroud 10 compared with the same shroud where the gap 44 is filled with metal. It also provides an indication of the remaining heel shroud life. When the inner body 14 is sufficiently worn away to expose the air gap 44, this will be easily noted by a maintenance worker and provides a ready indication that replacement is required.

Figure 8:
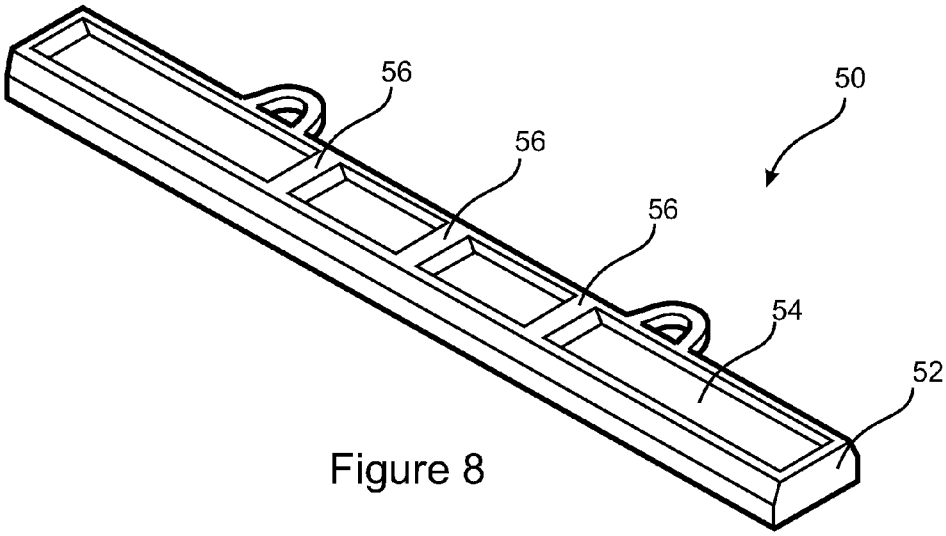
FIG. 8 is an upper perspective of a wear bar in accordance with the present invention.
Figure 9:
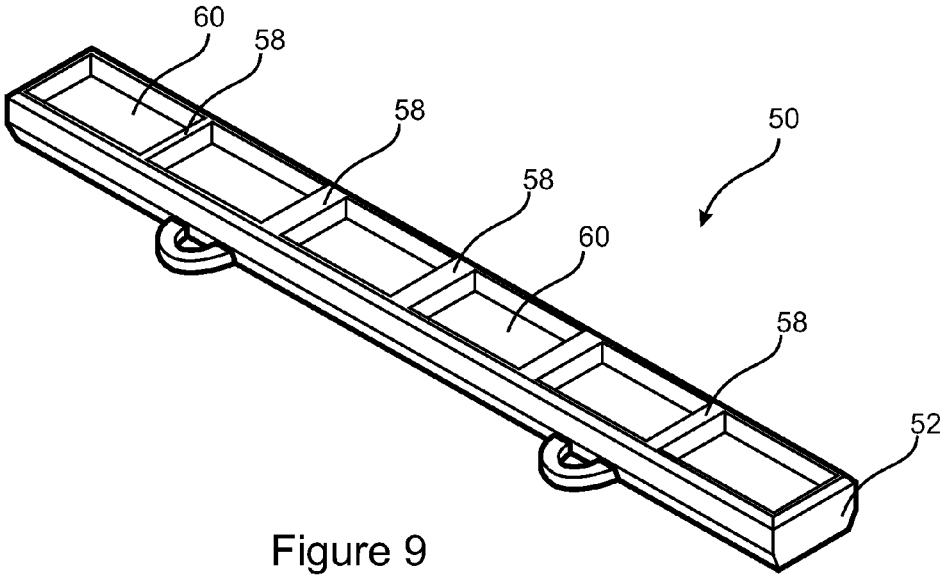
FIG. 9 is a lower perspective of the wear bar of FIG. 8.

FIGS. 8 and 9 are upper and lower perspectives of a wear bar 50 formed according to similar principles to the heel shroud 10. The wear bar 50 has an outer shell 52, and a cavity 54 in which an inner body can be formed.

In contrast to the heel shroud 10, the wear bar 50 uses a plurality of transverse cross portions 56 and no longitudinal cross portions. This is a result of the geometry of the wear bar 50, which is inherently narrow. In the embodiment of the drawings, the wear bar 50 has three spaced transverse cross portions 56.

Similarly, the wear bar 50 has five supporting members 58 equally spaced along its underside, as can be seen in FIG. 9. The supporting members 58 allow for the creation of air gaps 60 between the wear bar 50 and a bucket to which it is welded.

Figure 10:
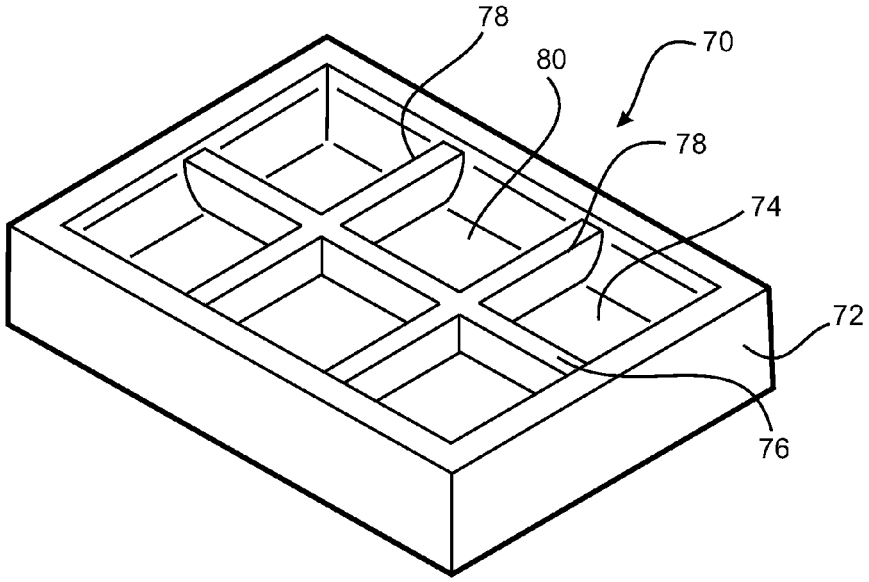
FIG. 10 is an upper perspective of a wear cap in accordance with the present invention.
Figure 11:
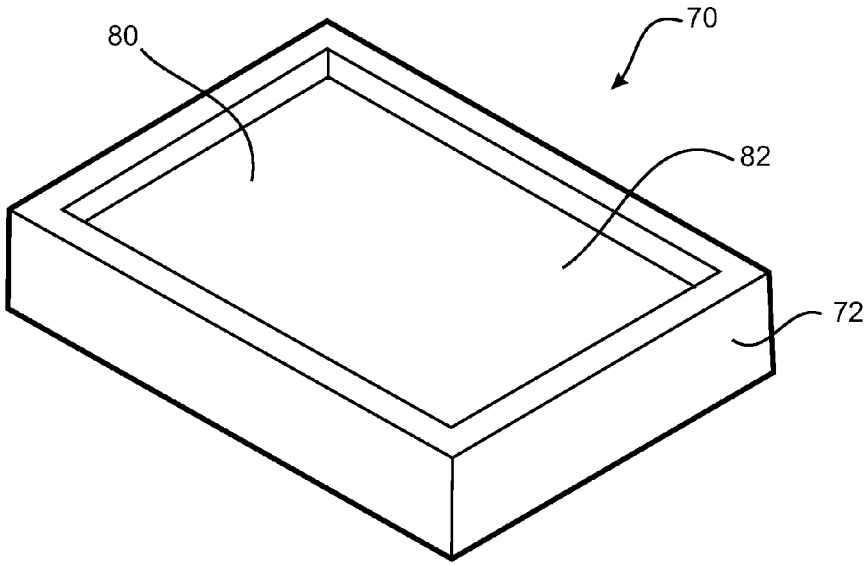
FIG. 11 is a lower perspective of the wear cap of FIG. 10.

FIGS. 10 and 11 are upper and lower perspectives of a wear cap 70 formed according to similar principles to the heel shroud 10. The wear cap 70 has an outer shell 72, and a cavity 74 in which an inner body can be formed.

Similarly to the heel shroud 10, the wear cap 70 has a single longitudinal cross portion 76 and two transverse cross portions 78. These are arranged similarly to those of the heel shroud 10, with the principle difference being that both the longitudinal cross portion 76 and the transverse cross portions 78 are spaced from a base 80 of the cavity 74, to allow for creation of a contiguous inner body.

The wear cap 70 has an air gap 82 formed on its under side, as can be seen in FIG. 11. The wear cap 70 is sufficiently small that supporting members are not required. Rather, side and end walls of the wear cap 70 extend beyond the base 80 in order to create the air gap 82.

It will be appreciated that other wearing parts can be made in a similar fashion to the heel shroud 10, the wear bar 50 and the wear cap 70 discussed above. Modifications and variations as would be apparent to a skilled addressee are deemed to be within the scope of the present invention.

The invention claimed is:

1. A wear component formed from at least a first metallic material and a second metallic material, the first material having a toughness greater than that of the second material and the second material being more abrasion resistant than the first material; the wear component having a shell formed from the first material and a contiguous inner body formed from the second material, a metallurgical bond existing between the first material and the second material; wherein the shell includes at least one cross portion extending through the inner body, the cross portion being formed from the first material and having a first side and a second side each of which are bonded to the second material, the cross portion having a lower side extending between the first side and the second side, the lower side being bonded to the second material.

2. A wear component as claimed in claim 1 wherein the cross portion is elongate, with the first side being along one longitudinally extending side of the cross portion and the second side being on an opposite longitudinally extending side of the cross portion.

3. A wear component as claimed in claim 2, wherein the shell includes a plurality of cross portions.

4. A wear component as claimed in claim 3 wherein at least two cross portions are parallel to each other.

5. A wear component as claimed in claim 3, wherein at least one cross portion intersects another cross portion within the inner body.

6. A wear component as claimed in claim 2, wherein the shell includes opposed end walls with at least one cross portion extending between the opposed end walls.

7. A wear component as claimed in claim 2, wherein the shell includes opposed side walls with at least one cross portion extending between the opposed side walls.

8. A wear component as claimed in claim 2, wherein the shell defines a volume arranged to contain the inner body, the volume having a base, and an upper edge which is defined by upper edges of end walls and side walls of the shell, and wherein at least some of the cross portions are arranged such that the shell includes a space between a least part of these cross portions and the base.

9. A wear component as claimed in claim 8 wherein at least some of the cross portions are arranged so as to have an upper edge which is level with the upper edges of the end walls and side walls.

10. A wear component as claimed in claim 1 wherein the wear component is arranged for attachment to an excavator bucket.

11. A wear component as claimed in claim 10 wherein the wear component is a heel shroud.

12. A wear component as claimed in claim 10 wherein the wear component is a wear bar.

13. A wear component as claimed in claim 10 wherein the wear component is a wear cap.

14. A wear component as claimed in claim 10 wherein the wear component is a corner shroud.

15. A wear component as claimed in claim 10 wherein the wear component is a wing shroud.

* * * * *